United States Patent [19]

Weisenburger et al.

[11] 4,324,450

[45] Apr. 13, 1982

[54] DROP WIRE TERMINAL

[75] Inventors: Lawrence P. Weisenburger; Henry L. Delguidice, both of Winston-Salem, N.C.

[73] Assignee: AMP Inc., Harrisburg, Pa.

[21] Appl. No.: 127,282

[22] Filed: Mar. 5, 1980

[51] Int. Cl.[3] ..... H01R 4/24

[52] U.S. Cl. ..... 339/97 R

[58] Field of Search ..... 339/97 R, 96, 97

[56] References Cited

U.S. PATENT DOCUMENTS

| | | | |
|---|---|---|---|
| 3,189,704 | 5/1965 | Raymond et al. | 339/97 R |
| 3,218,602 | 11/1965 | Morse | 339/97 R |
| 3,233,206 | 2/1966 | Fiala | 339/98 |
| 3,422,391 | 1/1969 | Thomson | 339/97 R |
| 3,824,527 | 7/1974 | Evans | 339/97 R |
| 3,879,099 | 4/1975 | Shaffer | 339/99 R |
| 3,932,018 | 1/1976 | Parsons et al. | 339/99 R |
| 4,062,616 | 12/1977 | Shaffer et al. | 339/99 R |

*Primary Examiner*—Eugene F. Desmond
*Attorney, Agent, or Firm*—Gerald K. Kita

[57] ABSTRACT

A single metal blank is stamped and formed to provide an electrical terminal which includes sets of jaws which are closed toward one another to penetrate through insulation of a wire conductor and to grippingly engage the conductor. The jaws are closed readily by a pair of pliers. The terminal may be applied as a tap-off along one of a pair of wire connectors without disturbing the other conductor.

7 Claims, 11 Drawing Figures

DROP WIRE TERMINAL

FIELD OF THE INVENTION

This invention relates to a field applied electrical terminal which terminates a telephone drop wire to a binding post, or which provides a tap-off selectively along one of a pair of conductors, commonly comprising a telephone drop wire.

BACKGROUND OF THE INVENTION

A telephone drop wire consists of two solid or stranded wire conductors alongside each other within a sheath of insulation. The wire provides electrical power and ground return to a telephone subscriber's building, such as a residence. The drop wire is terminated to a terminal block outside the building. The individual telephones within the building are wired to the terminal block, and consequently are connected to the power and ground return provided by the terminated drop wire.

The standard procedure for terminating the drop wire conductors, is to strip the insulation sheath from the ends of the conductors, loop and wrap the exposed ends of the conductors around respective threaded, conductive binding posts which are mounted on the terminal block, and threadably advance nuts along the posts tightly against the wires. The quality of the resulting electrical connections depends upon the skill and thoroughness by which the laborious tasks are performed. In the case of stranded wire, stripping exposes hard drawn steel strands which can not be satisfactorily looped around the binding post.

SUMMARY OF THE INVENTION

The present invention separates the act of terminating the wire conductor from the task of connecting the conductor to the binding post. The separate tasks are performed more quickly and with less effort than the previous standard procedure. A single-piece, stamped and formed terminal having sets of multiple jaws are closed, both toward one another, and over one of the unstripped conductors of the drop wire. The jaws penetrate through the sheath, and gather or bunch together the strands of the conductor and grippingly make contact with the conductor. The closed terminal is then laid over the binding post, supporting itself thereon until made fast by tightening the binding nut.

The inherent spring properties of the drop wire strands allow the terminal to maintain secure grip on the gathered strands of the wire, and maintain the jaws in closed together relationship. Stops are provided to limit jaw closure. The jaws are positioned initially in partially closed relationship to facilitate full closure by a gripping tool such as a pair of pliers.

OBJECTS

An object of the present invention is to provide a single-piece, stamped and formed electrical terminal with sets of wire receiving and gripping jaws which are closed together, for gathering and grippingly contacting the strands of a wire conductor.

Another object is to provide an electrical terminal having stop means to prevent the opposed conductor gripping jaws from being closed too far.

Another object is to provide an electrical terminal which penetrates a drop wire insulation, gathers and makes contact to the strands of a conductor of the drop wire, and provides a binding post connection for the conductor.

Another object is to provide an electrical terminal which separates electrical termination of a drop wire conductor from connection of the conductor to a binding post.

Other objects and advantages of the present invention will become apparent from the following detailed description taken in conjunction with the drawings.

DETAILED DESCRIPTION OF THE DRAWINGS

Figure 2:
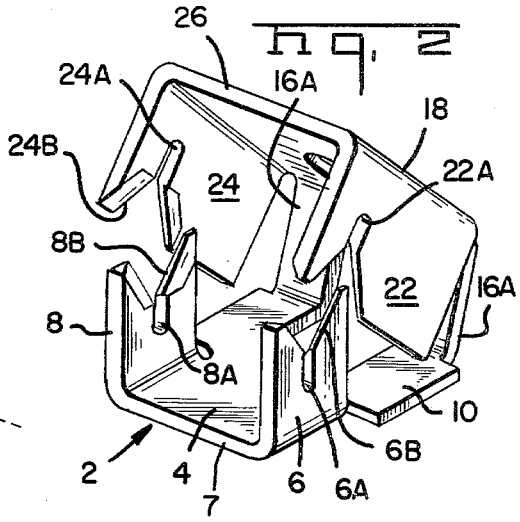
FIGS. 2 and 3 are enlarged perspectives from different viewpoints of a terminal according to the present invention.
Figure 3:
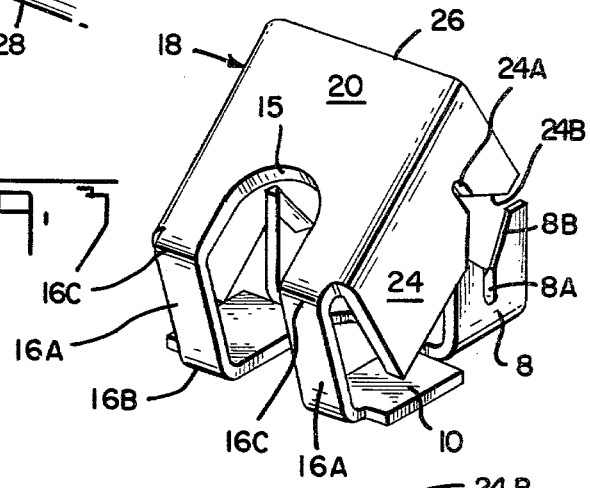
Figure 4:
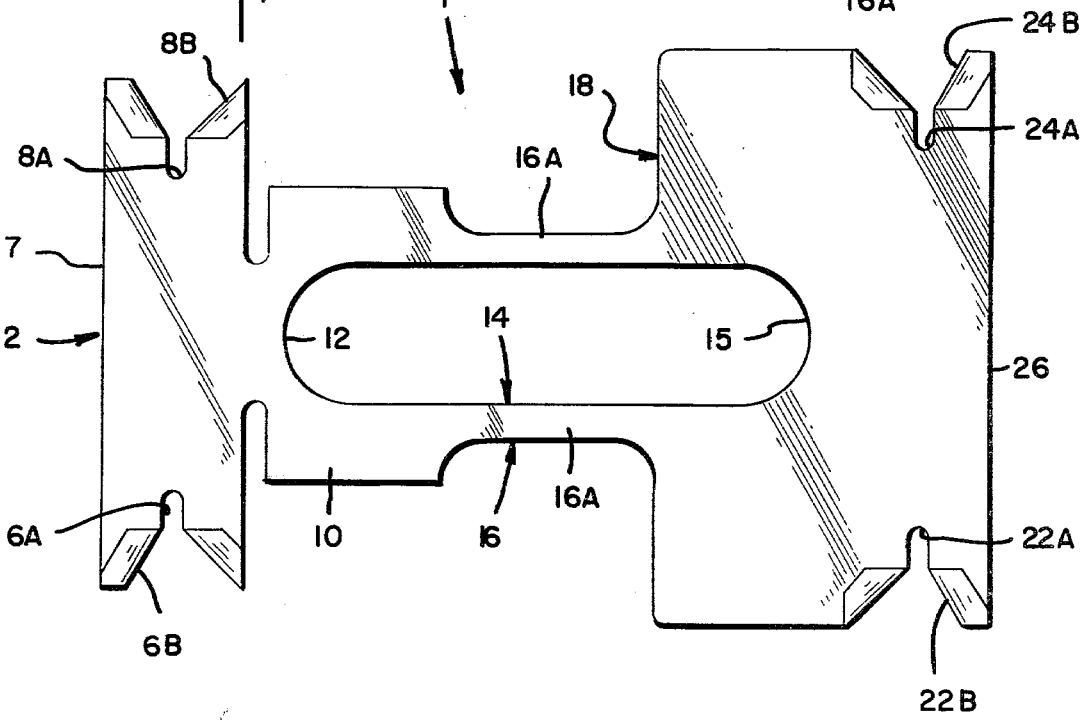
FIG. 4 is an enlarged plan view of a one-piece, stamped metal blank prior to formation into the terminal as shown in FIGS. 2 and 3.

With more particular reference to FIG. 4, there is shown generally at 1, a single piece, metal blank stamped to the configuration as shown. The blank includes a first wire terminating section 2 which, as shown in FIG. 2, is formed with a first bight section 4 interconnecting a pair of opposed, first plate portions 6 and 8 bent outwardly from the plane of said first bight section. The plate portions are provided with respective open ended slots 6A and 8A. The slot 6A has a flared open entry 6B which provides a wire entry and a strand gathering function. A similar entry 8B is provided for the slot 8A. The bight section 4 is coplanar and integral with a flange 10 which projects laterally aside the plate portions 6 and 8. As shown in FIG. 4 the flange 10 is partially bifurcated by one rounded end portion 12 of an elongated opening 14. The opening 14 extends through a web portion 16, dividing the web portion into a pair of relatively narrow, elongated webs 16A which integrally connect the flange 10 to a second wire terminating section 18 which, as shown in FIGS. 2 and 3, is formed with a second bight section 20 integrally joining the webs 16A and integrally interconnecting opposed second plate portions 22 and 24 that are bent outwardly from the plane of said bight section 20. These second plate portions 22 and 24 are spaced farther apart than the first plate portions 6 and 8 of the first terminating section. A rounded end 15 of the opening 14 extends partially into the bight section 20. The plate portions 22 and 24 are provided with respective, aligned, open ended, wire receiving slots 22A and 24A. The slot 22A is provided with a flared open entry 22B which provides a wire entry and a wire strand gathering function. The slot 24A is provided with a similar flared entry 24B. The slots 22A and 24A are offset along the respective plate portions 22 and 24 in the same direction toward an outer edge margin 26 of the wire terminating section 18.

As shown in FIGS. 2, 3, and 4, each of the webs 16A is formed with a partial bend 16B adjacent the flange 10, and a second partial bend 16C adjacent the bight section 20. These partial bends serve as permanently deformable hinges which initially serve to locate the second terminating section 18 in a position partially closed toward said first termination section 2. The upper plate portions 22 and 24 are opposite and spaced from respective lower plate portions 6 and 8.

Figure 1:
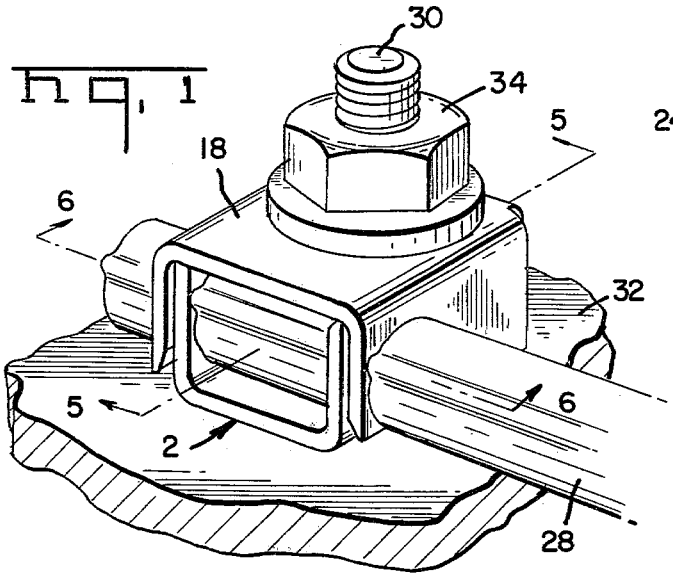
FIG. 1 is an enlarged fragmentary perspective of a wire termination and a binding post connection accomplished by a terminal according to the present invention.
Figure 5:
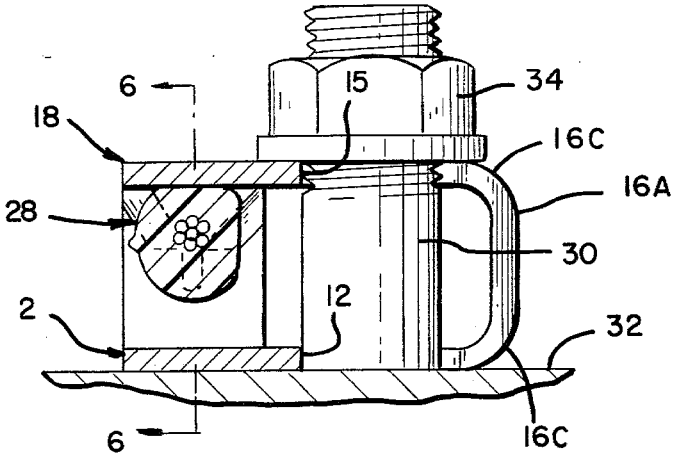
FIG. 5 is a fragmentary elevation in section of the connection shown in FIG. 1.

To use the terminal, first an insulated conductor 28 is passed through the terminal, so that the conductor 28 extends between each respective pair of an upper and a lower plate portion. A pair of pliers is used to pivot the terminating sections 2 and 18 toward each other, causing pivotal deformation of the bends 16B and 16C. As the terminating sections 2 and 18 close together, the wire 28B of the conductor 28 is forced simultaneously into and along the slots 6A, 8A, 22A and 24A. The opposite sides of each aforesaid slot define opposed, insulation slicing and wire engaging jaws, spaced apart less than the composite diameter of the wire 28B which is to be terminated between each set of jaws. The opposite sides of each of the aforesaid slots slice through the insulation 28A of the conductor 28 to contact the wire 28B. The inherent metal spring properties of the terminal allow the opposed jaws to exert continuous resilient gripped contact with the wire strands. The flared entry of each slot tends to funnel or gather the strands to assure entry of all strands into the corresponding wire terminating slot. The finished termination is illustrated in FIGS. 1, 5, and 6.

Complete closure of the terminal is assured when the plate portions 6 and 8 bottom or stop against the bight section 20, and when the unslotted portions of the plate portions 22 and 24 stop against the flange 10. Additionally, the stop function of the bight section 20 and flange 10 prevents the terminating sections 2 and 18 from being closed too far. The terminal is locked into its fully closed configuration and is prevented from opening or unfolding. The insulated conductor 28 is terminated within the slot jaws of the fully closed wire terminating sections 2 and 18.

Figure 6:
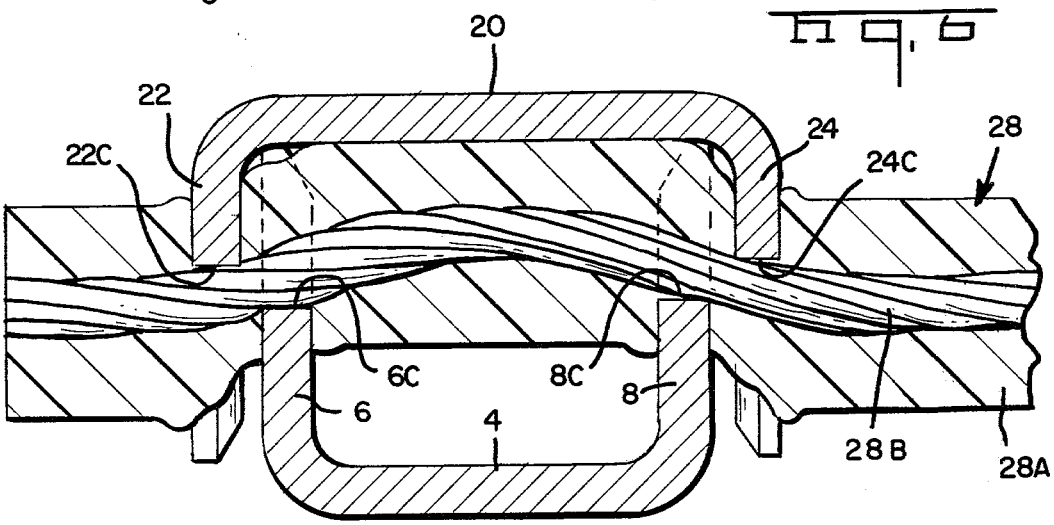
FIG. 6 is an enlarged fragmentary section taken along the line 6—6 of FIG. 5.

As shown in FIG. 6, the overlying plate portion 22 closely overlaps the plate portion 6 to prevent unfolding of the plate section 6 toward the plane of the bight section 4. Further, the stranded conductor 28B is forced against the closed ends 6C and 22C of the wire terminating slots of the plate portions 6 and 22, forcing the conductor into a clearance separating the slot ends 22C and 6C. Similarly, the plate portion 24 overlaps the plate portion 8 and the strand conductor 28B is jammed in the clearance separating the closed ends 24C and 8C of the slots 24 and 8, respectively. If the strands of the conductor 28B are copper plated steel, it is important that the sides of the slots of each of the plates 6 and 8 be supported at both ends, namely against the bight section 20 and by integral juncture thereof with the bight section 4. In the fully closed terminal, the rounded ends 12 and 15 of the opening 14 are in alignment, so as to be received over a conductive binding post 30 projecting from an insulated base 32 of a terminal block of which the binding post is a part. A threaded binding nut 32 is threadedly advanced over the binding post to secure the terminal fast and to urge the terminating sections 2 and 18 toward their fully closed positions.

Figure 7:
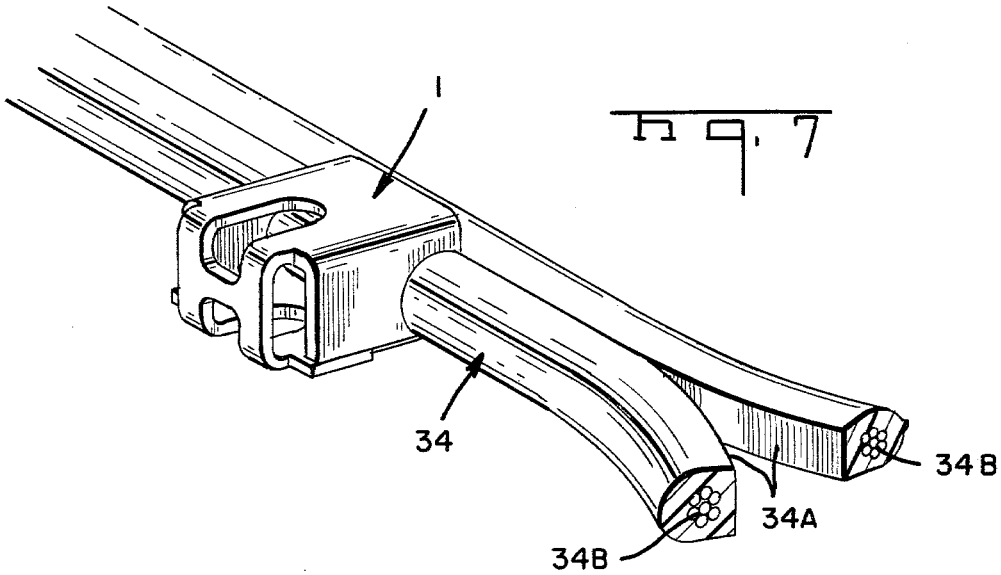
FIG. 7 is an enlarged fragmentary perspective of a tap-off connection of a terminal of the present invention to a stranded wire conductor.

FIG. 7 illustrates a drop wire cable 34 in which a pair of stranded wire conductors 34B are side-by-side within a common insulation sheath 34. The terminal 1 is terminated to one of the conductors 34B without having to split apart the cable or to separate the conductors 34B from each other. The slots 22A and 24A are adjacent the edge margin 26, and the slots 4A and 6A are adjacent the edge margin 7, so that the terminal does not bridge across both conductors 34B when terminated to only one conductor.

Another embodiment of the terminal is shown at 1A in FIGS. 8–11. The terminal 1A is similar to the terminal 1, with like numbers representing like parts. The plates 6 and 8 of the terminal 1A are provided with rounded shoulders 6C and 8C respectively. The plates 6 and 8 are provided with undercut shoulders 6D and 8D under respective shoulders 6C and 8C. The plates 22 and 24 are provided with respective bent tabs 22D and 24D, which initially project outwardly from the edge margin 26 and which are bent to project toward the opposite plate 22 or 24, respectively, to overlap respective plates 6 and 8. The tabs 22D and 24D are provided with undercut chamfered edges 22E and 24E, respectively.

Figure 8:
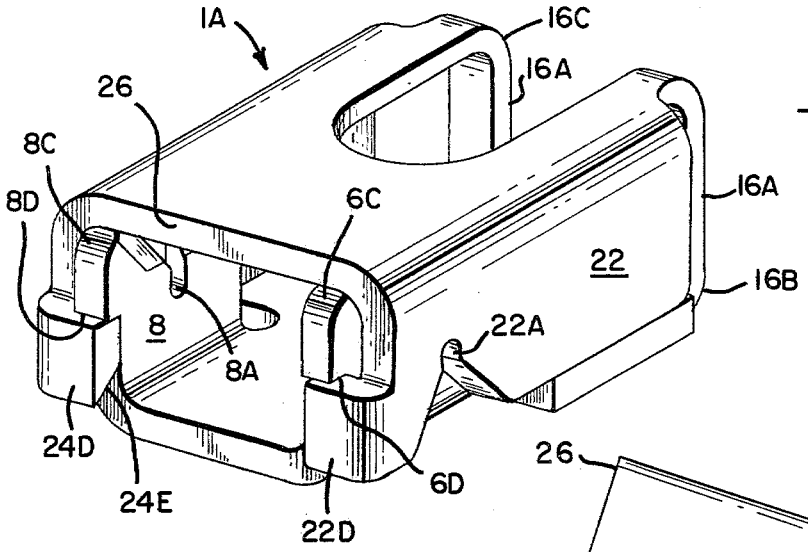
FIG. 8 is an enlarged perspective of another embodiment of a terminal in closed position without a wire to be terminated thereby.
Figure 9:
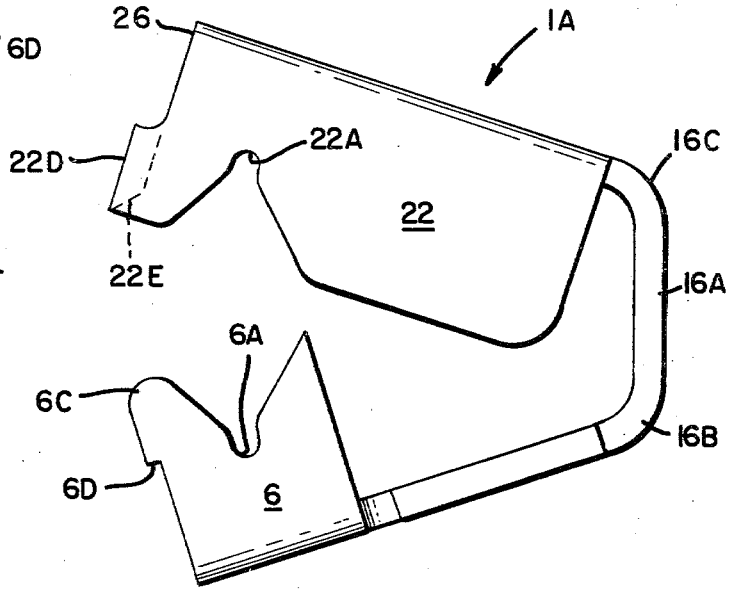
FIG. 9 is a side elevation of the terminal, shown in FIG. 8, in an open position.
Figure 10:
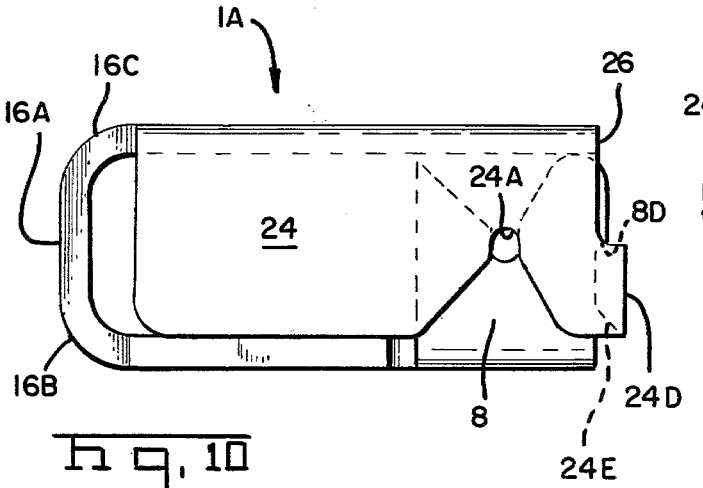
FIGS. 10 and 11 are elevations of the terminal shown in FIG. 8.
Figure 11:
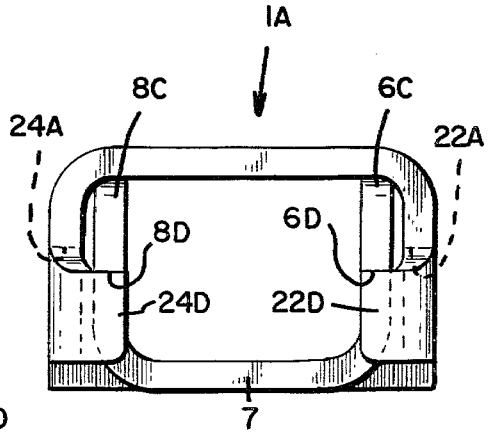

When the terminal 1A is closed, the edges 22E and 24E slidably impinge the shoulders 6C and 8C, respectively. The rounded shoulders cam the edges 22E and 24E of the tabs 22D and 24D, and align the slot 24A with the slot 8A, and the slot 22A with the slot 6A, so that all the aforesaid slots will be forced over a conductor to be terminated, similarly as described in reference to the terminal 1. To latch the terminal 1A in the closed position as shown in FIGS. 8, 10 and 11, the tabs 22D and 24D will latch against the respective undercut shoulders 6D and 8D. The inherent spring properties of the terminal will exert continuous pressure of the tabs 22D and 24D against the undercut shoulders 6D and 8D, and against the edge margin 7 of the plates 6 and 8.

Although preferred embodiments of the present invention are disclosed and described in detail, other modifications apparent to those having ordinary skill in the art are intended to be covered by the spirit and scope of the claims.

What is claimed is:

1. A terminal for electrical connection to a stranded wire conductor, the terminal being stamped and formed from a single metal blank and comprising:

a first terminating section formed with a first bight section interconnecting a pair of opposed first plate portions bent outwardly from said first bight section, said pair of first plate portions having aligned open ended slots, the sides of which define opposed insulating slicing and wire engaging jaws spaced apart a distance less than the diameter of a wire conductor to be engaged between said jaws, a second terminating section opposed from said first terminating section, said second terminating section being formed with a second bight section interconnecting a pair of opposed second plate portions bent outwardly from said second bight section and spaced farther apart than said first plate portions, said second plate portions being provided with aligned open ended slots the sides of which define opposed insulation slicing and wire engaging jaws, spaced apart less than the diameter of a wire conductor to be terminated between said jaws, a flange adjacent to and coplanar with said first bight section, said flange projecting laterally aside said first plate portions, a web portion connecting said second terminating section with said flange, said second terminating section being pivotable by bending said web portion to close toward said first terminating section and said flange, so that said slots of said first and said second plate portions are brought into alignment and simultaneously receive a wire conductor therein and establish electrical connection thereto, said flange providing a stop against which said second plate portions engage to limit pivoting of said terminating sections relative to each other, and said web portion having one or more bends therein, initially positioning said second terminating section partially closed toward said first terminating section.

2. The structure as recited in claim 1, wherein, said first plate portions engage said bight section of said second terminating section when said terminating sections are fully closed toward each other.

3. The structure as recited in claim 1, wherein, said metal blank includes an elongated opening in said flange, said web portion and said bight section of said second terminating section.

4. The structure as recited in claim 1, wherein, said web portion is bifurcated by a cutout to provide a pair of relatively thin, elongated webs, each having a first bend adjacent said flange and a second bend adjacent said second bight section, each of said bends providing a hinge for pivoting said second terminating section toward said first terminating section.

5. The structure as recited in claim 1, wherein said second plate portions latch to said first plate portions to maintain said terminal in a closed position.

6. The structure as recited in claim 1, wherein said first plate portions include cam means for camming said second plate portions during closure of said terminal.

7. The structure as recited in claim 6, wherein said first plate portions include undercut shoulders, and said second plate portions include projecting tabs slidably engaging said cam means for camming said second plate portions during closure of said terminal, said tabs latchably engaging said undercut shoulders upon closure of said terminal.

* * * * *